United States Patent [19]

Koper et al.

[11] 4,455,060

[45] Jun. 19, 1984

[54] RING LASER GYRO CATHODE CONNECTION

[75] Inventors: James G. Koper; Bo H. G. Ljung, both of Wayne, N.J.

[73] Assignee: The Singer Company, Little Falls, N.J.

[21] Appl. No.: 398,037

[22] Filed: Jul. 14, 1982

[51] Int. Cl.[3] ..... H01R 13/12

[52] U.S. Cl. ..... 339/252 S; 339/256 RT

[58] Field of Search ..... 339/251, 252 S, 255 RT, 339/256 RT

[56] References Cited

U.S. PATENT DOCUMENTS

| | | | |
|---|---|---|---|
| 1,505,531 | 8/1924 | Bensett | 339/256 RT |
| 1,668,381 | 5/1928 | Schild | 339/256 RT |
| 2,898,102 | 8/1959 | Armstrong | 339/255 RT |
| 2,912,668 | 11/1959 | Eddy | 339/256 RT |

*Primary Examiner*—Joseph H. McGlynn

*Attorney, Agent, or Firm*—Joel Miller; Thomas W. Kennedy

[57] ABSTRACT

This solderless electrical connector for an electrical cable consists of a helical spring and loop joined together to form a ring. The helical spring provides a snug fit on a matching cylindrical post while offering strain relief protection for the electrical cable, which is routed through the helix of the spring.

3 Claims, 3 Drawing Figures

FIG. 1
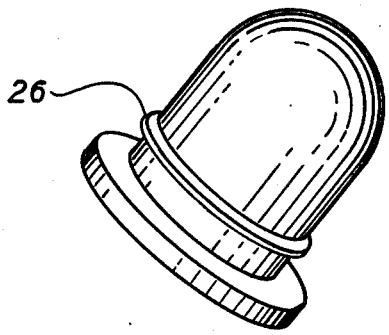
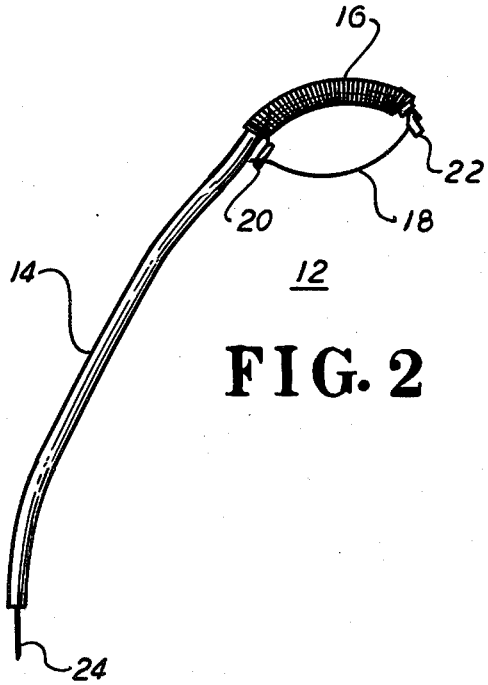
FIG. 2
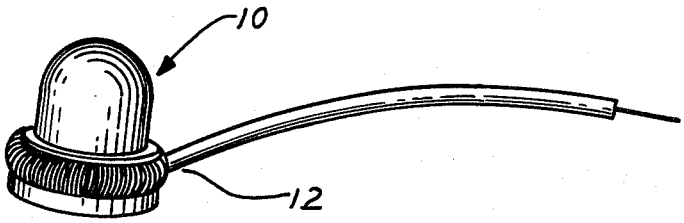
FIG. 3

RING LASER GYRO CATHODE CONNECTION

BACKGROUND OF THE INVENTION

This invention relates to electrical connectors. More particularly, this invention is directed to connectors for use in environments experiencing severe vibration and extreme temperature.

Connecting an electrical wire to a cylindrical post is generally a simple matter. One possible solution is to solder the wire directly to the post. In the design and manufacture of ring laser gyroscopes, a high voltage wire must be connected to the cathode, which is a cylindrically shaped device approximately one inch in diameter. One end of the cathode is terminated in a dome and the other end is flared out to a flange. The accepted method of connecting the wire to the cathode has been to insert a phosphor bronze pin directly into the flange of the cathode and to connect the wire to this pin by soldering.

The method described above has several disadvantages. Inherent in the operation of some versions of the ring laser gyroscope is dithering, a continuous vibration necessary for the operation of the gyroscope. Direct connection to a pin staked into the cathode offers no strain relief for the wire at the solder joint. The vibrations flex the wire and may ultimately cause a brittle failure of the wire close to the joint. To overcome the vibration problem, a special strain relief arrangement must be added, thus increasing the cost of the unit. Furthermore, the solder connection is made several times as a gyroscope is assembled. At each reconnection, the portion of the wire soldered to the pin is cut off to prevent brittle failure at the pin, shortening the cable until it must be replaced. Also, the heat from the soldering may melt the sealing material adjacent the cathode case, defeating the vacuum seal between the cathode and the gyroscope body.

Because the cathode of the ring laser gyroscope is typically thermally oxidized at temperatures very close to its melting temperature, the phosphor bronze pin also oxidizes very heavily. This condition may prevent one from making an adequate solder joint and cause a failure of the electrical path between the phosphor bronze pin and the aluminum alloy of the case.

It is therefore desired to create a connector that mounts to the cathode case without the necessity of a solder connection. Furthermore, the connection should provide strain relief protection for the wire.

SUMMARY OF THE INVENTION

The connector according to the invention is basically a ring that encircles the cylindrical cathode case. The ring is divided into two portions; the first part is a helical spring and the second part is a loop fashioned from a straight piece of wire. The spring and loop are connected to each other by solder connections and the connecting cable is soldered to one of the junctions. For strain relief protection, the cable is snaked through the spring from one end toward the other where it is joined by solder to the junction of the loop and the spring. To ensure that there will be no slippage of the connector, a ridge is provided on the case.

For a better understanding of the present invention together with other and further objects, reference is made to the following description taken in conjunction with the accompanying drawings.

BRIEF DESCRIPTION OF THE DRAWINGS

FIG. 1 is a perspective drawing of the cathode case.

FIG. 2 is a drawing of the connector according to the invention.

FIG. 3 is a drawing of the connector positioned on the cathode.

BRIEF DESCRIPTION OF THE PREFERRED EMBODIMENT

A cathode case 10 used in the ring laser gyroscope is illustrated in FIG. 1. The connector 12 that mates with the case is illustrated in FIG. 2.

A high voltage insulated cable 14 is commonly used in this application. The connector consists of a helical spring 16 and a loop 18, which are joined at junctions 20 and 22 by soldering. The cable 14 is inserted into the helix of the spring at one junction 20 and is pushed through toward the other junction 22 where the wire 24 is soldered to the junction 22. The size of the spring 16 and the loop 18 are chosen such that a tight fit results when the connector 12 is placed on the case 10.

A ridge 26 is machined on the exterior surface of the cathode case 10 to provide positive seating of the coating connector 12. Thus, vibration will not shake the connector 12 loose.

An alternative method of producing the ridge is to create one or more point projections on the surface of the cathode. This may be achieved by applying a deposit of an epoxy resin or some other suitable material.

The connector 12 according to the invention provides a highly reliable electrical connection. The wire loop 18 and the spring 16 combination afford many hard point-contacts resulting in a low resistance connection. The connector 12 may be attached or removed without tools permitting easier maintenance.

For ease of construction, the spring 16 and the loop 18 can be made from an integral piece of wire.

FIG. 3 shows the connector 12 positioned on the cathode case 10.

While there has been described what is believed to be the preferred embodiment of the invention, those skilled in the art will recognize that other and further modifications may be made thereto without departing from the spirit of the invention, and it is intended to claim all such embodiments as fall within the true scope of the invention.

We claim:

1. A cathode assembly for a ring laser gyro, including a cathode post having an annular portion, and including an electrical connector mounted on said post annular portion, said electrical connector comprising:

a generally circular ring mounted on said post annular portion, said ring being circumferentially divided, said ring having first and second spaced junctions disposed on diametrically opposite sides thereof for forming a first partial circumference and a second partial circumference, said first partial circumference being a helical spring defining a helix and said second partial circumference being a loop of wire; and an electrical cable having one end connected to said ring at said second junction, where the portion of said cable adjacent said end is connected to said second junction and is positioned in and extends through the interior of said helix of said helical spring from said second junction to said first junction, and where said electrical cable is an insulated cable comprising an inner electrical conductor and an outer insulated covering.

2. An electrical connector as set forth in claim 1 where said post annular portion is provided with at least one projection for forming an annular groove in order to receive said connector and to prevent slippage of said connector.

3. An electrical connector as set forth in claim 1 where said spring and loop are constructed from a single place of wire.

* * * * *